United States Patent [19]

Kremer et al.

[11] Patent Number: 4,786,227

[45] Date of Patent: Nov. 22, 1988

[54] AUTOMATED APPARATUS FOR LINING THE INSIDE WALL OF A VESSEL WITH BRICKS

[75] Inventors: Victor Kremer; Michel Kirchen, both of L-Luxembourg; Emile Lonardi, L-Bascharage, all of Luxembourg

[73] Assignee: Paul Wurth, S.A., Luxembourg, Luxembourg

[21] Appl. No.: 58,460

[22] Filed: Jun. 5, 1987

[30] Foreign Application Priority Data

Jun. 5, 1986 [LU] Luxembourg ..... 86458

[51] Int. Cl.[4] ..... C21C 5/44; E04G 21/16

[52] U.S. Cl. ..... 414/10; 266/281

[58] Field of Search ..... 414/10; 266/281; 52/747, 749

[56] References Cited

U.S. PATENT DOCUMENTS

| | | | |
|---|---|---|---|
| 3,757,484 | 9/1973 | Williamson et al. | 414/10 X |
| 4,688,773 | 8/1987 | Legille et al. | 414/10 X |
| 4,708,562 | 11/1987 | Mélan et al. | 414/10 |
| 4,720,226 | 1/1988 | Legille et al. | 414/10 |

FOREIGN PATENT DOCUMENTS 2070868 9/1971 France .

*Primary Examiner*—Leslie J. Paperner

*Attorney, Agent, or Firm*—Fishman, Dionne & Cantor

[57] ABSTRACT

The apparatus of the present invention utilizes a brick-laying robot which comprises an automatic brick-handling or grabbing device fastened to the end of a main arm which is carried by a frame mounted on a work platform; and which is radially movable relative to the platform. Circular movement of the arm and of the grabbing device relative to the vertical axis of the work platform is generated as result of a rotation of the platform about this vertical axis. The present invention also utilizes a storage table which is mounted underneath the main arm of the robot, so as to be movable along a vertical axis and rotatable about the axis. The present invention further includes an automatic depalletizing mechanism comprising a pivoting arm, of which one of the ends is equipped with a brick-grasping device and the other end is mounted pivotally on a support sliding parallel to the main arm of the robot between two rails of the frame. This brick lining apparatus is less bulky than known prior art apparatuses and offers monitoring personnel a greater degree of safety.

16 Claims, 3 Drawing Sheets

AUTOMATED APPARATUS FOR LINING THE INSIDE WALL OF A VESSEL WITH BRICKS

BACKGROUND OF THE INVENTION

This invention relates to an automated apparatus for lining the inside wall of a vessel with bricks. More particularly, this invention relates to a brick laying apparatus comprising a work platform vertically movable within the vessel and capable of rotating about the vertical axis of the latter, a device for raising and lowering brick pallets and depositing them at a predetermined location on the platform, an automatic depalletizing mechanism for transferring the bricks from the pallets towards an intermediate storage table, a handling robot for picking up the bricks from the storage table and putting them in place, and a monitoring station.

Brick lining apparatus of the type described herein are particularly useful for repairing metallurgical converters and are discussed in Luxembourg patent applications Nos. 86,114 and 86,189 corresponding respectively to U.S. patent application Ser. Nos. 915,635 filed Oct. 6, 1986, now U.S. Pat. No. 4,7081,562 and 937,587 filed Dec. 3, 1986, now U.S. Pat. No. 4,720,226, both of which are assigned to the assignee hereof and incorporated herein by reference. In these prior art apparatuses, the robot is of relatively large bulk in terms of the space it requires for installation and the execution of its pivoting movements. Moreover, since the monitoring personnel must move about on the platform as required, the sweeping movement of the robot is a constant danger to the personnel. This is particularly so because it is not possible to provide a protective handrail since a handrail would preclude the robot from executing the necessary movements.

SUMMARY OF THE INVENTION

The above-discussed and other problems and deficiencies of the prior art are overcome or alleviated by the improved apparatus for lining bricks along the inside of a vessel of the present invention. In accordance with the present invention, an improved apparatus is provided which is less bulky than known prior art apparatuses and which offers monitoring personnel a greater degree of safety.

An important feature of the apparatus of the present invention is that the bricklaying robot comprises an automatic brick-handling or grabbing device fastened to the end of a main arm which is carried by a frame mounted on the platform; and which is radially movable relative to the platform. Circular movement of the arm and of the grabbing device relative to the vertical axis (of the platform) is generated as result of a rotation of the platform about this vertical axis. The rotation of the platform is preferably generated by an electric stepping motor.

An important advantage achieved by the apparatus of the present invention is that the main arm of the robot no longer executes a sweeping movement relative to the platform (as in the prior art). This not only reduces the bulk, but also increases the safety of the personnel considerably.

The present invention also utilizes a storage table which is mounted underneath the main arm of the robot, so as to be movable along a vertical axis and rotatable about said axis. The present invention further includes an automatic depalletizing mechanism comprising a pivoting arm, of which one of the ends is equipped with a brick-grasping device and the other end is mounted pivotally on a support sliding parallel to the main arm of the robot between two rails of the frame. Each of the pallets is deposited on a stage which is movable in the vertical direction.

The above discussed and other features and advantages of the present intention will be appreciated and understood by those skilled in the art from the following detailed description and drawings.

BRIEF DESCRIPTION OF THE DRAWINGS

Referring now to the drawings, wherein like elements are numbered alike in the several FIGURES:

FIGS. 2 to 10 show diagrammatically the movements executed by the automatic depalletizing mechanism in end positions relative to each pallet.

DESCRIPTION OF THE PREFERRED EMBODIMENT

Figure 1:
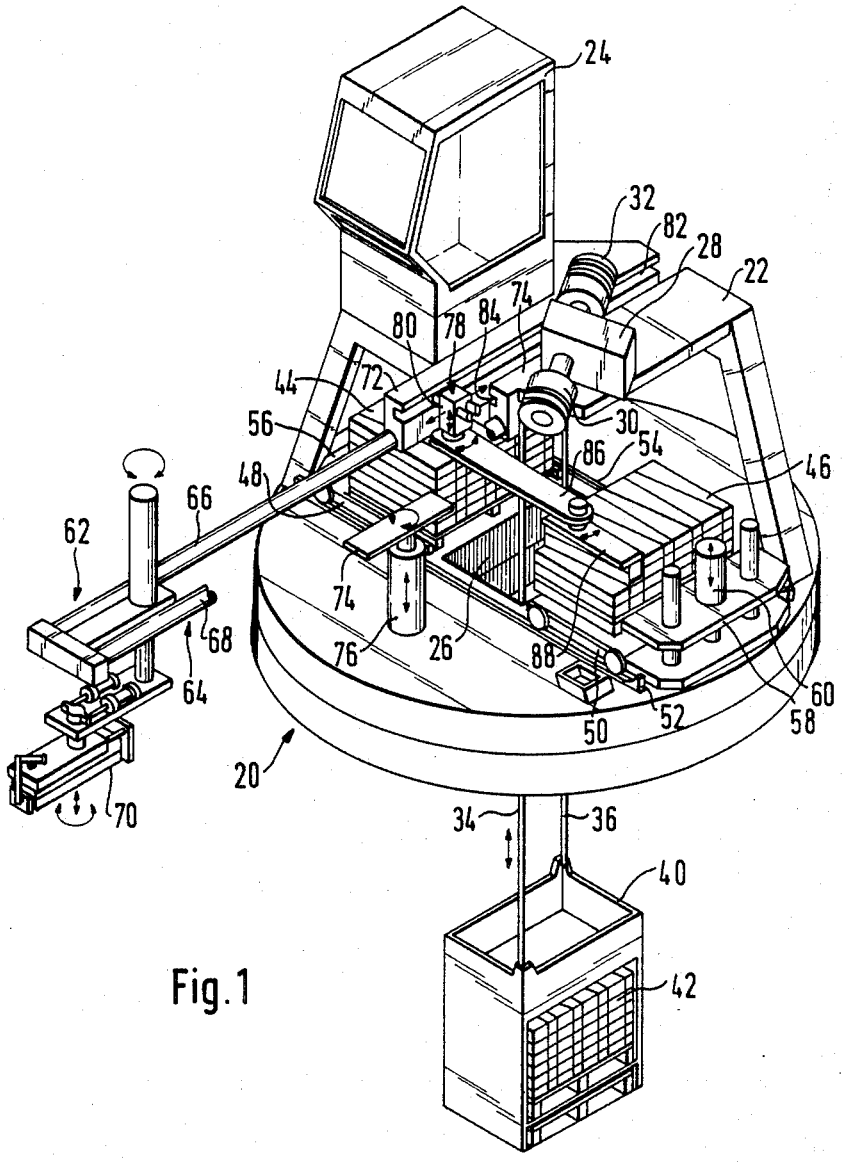
FIG. 1 is a perspective view of an apparatus accordance with the present invention.

The apparatus illustrated in FIG. 1 comprises a platform 20 capable of being moved vertically and of rotating about a vertical axis under the action of a stepping motor. Arranged on platform 20 is a frame 22 carried by several supports erected on the platform. Frame 22 carries a booth 24 which can house the monitoring personnel, and a winch 28 located above an orifice 26 in platform 20. Winch 28 is equipped with two drums 30 and 32 for winding cables 34 and 36 intended for raising and lowering pallet 42 through orifice 26 in platform 20. Pallet 42 is preferably raised and lowered by means of a cage 40, as provided in the aforementioned U.S. application Ser. No. 937,587.

FIG. 1 shows two pallets 44 and 46 in the depalletizing position. The pallets, when lifted through orifice 26 by means of winch 28, are taken up by one of two carriages 48 or 50 capable of executing to-and-fro movements on rails 52 and 54 arranged on either side of orifice 26.

Also located on either side of central orifice 26 are two stages 56, 58 which, as a result of the movement of carriages 48 and 50 between the pallet receiving position above orifice 26 and their depalletizing position, as shown in FIG. 1, are engaged between pallets 44 and 46 and their supporting carriages 48 and 50. Stages 56 and 58 are vertically movable under the action of hydraulic jacks (only jack 60 associated with stage 58 being shown), so that it is possible to raise and lower each of pallets 44 and 46 and thus reduce the amount of vertical mobility of tongs 88.

The apparatus of the present invention also includes a robot 62 comprising an automatic grabbing device 70 mounted on the end of a main arm 64. Arm 64 consists of two rods 66 and 68 sliding radially in two supporting beams 72 and 74; with beams 72 and 74 forming a part of frame 22. The radial movement of arm 64 is executed under the action of a motor (not shown), the movements of which are coordinated with the control of robot 62. Grabbing device 70, the essential degrees of freedom of which are represented by arrows, is preferably of the type described in Luxembourg patent application No. 86,188, corresponding to U.S. application Ser. No. 937,646 filed Dec. 3, 1986, now U.S. Pat. No. 4,758,036, assigned to the assignee hereof, all of the contents which are incorporated herein by reference. However, it is also possible for grab 70 to be in the form of a suction cup, the difference being that a suction cup can only grasp a single brick whereas a grab possessing tongs (as illustrated in FIG. 1) is capable of grasping several bricks placed on top of one another.

Underneath main arm 64 of robot 62 is a storage table 74 for storing the bricks. Table 74 is mounted on the rod of jack 76 which permits table 74 to move vertically. Moreover, table 74 is preferably capable of rotating about its vertical axis in a controlled manner, this being symbolized by an arrow.

The present invention also includes an automatic deplattetizing mechanism identified generally at 78. Automatic depalletizing mechanism 78 comprises of a support 80 which can slide radially in the direction of arm 64 of robot 62 in guide grooves 82 and 84 made in beams 72 and 74. A pivoting arm 86 is mounted at one of its ends on support 80, so that under the action of pivoting means (not shown), it can pivot about a vertical axis relative to support 80. At the opposite end of pivoting arm 86 are mounted tongs 88 which are similarly capable of pivoting about a vertical axis relative to arm 86. Arm 86 is also movable vertically in relation to support 80, so that it can lift the bricks from pallets 44 and 46 by means of tongs 88.

All the possible movements of the components, the degree of freedom of which are symbolized by arrows, are executed automatically by means which are not shown (to avoid) overburdening the FIGURE); and which are controlled and operated automatically according to a specific brick-lining program. Thus, by means of automatic depalletizing mechanism 78, the bricks are transferred separately or in superimposed paris from each of pallets 44 and 46 to table 74 which is automatically raised or lowered to the level at which the bricks are received by the automatic mechanism 78 or to the level necessary for the bricks to be picked up by grab 70. As a result of the radial movement of arm 64, grab 70 shifts the bricks from table 74 to the laying point, as described in aforementioned U.S. patent application Ser. No. 937,646.

Because main arm 64 of robot 62 does not execute a pivoting movement relative to the vertical axis of the vessel, it is possible to arrange a handrail all round platform 20, in order to improve the safety of the personnel. Automatic depalletizing mechanism 78 is also no longer a danger, because these movements take place within frame 22 and are protected by the frame. On the other hand, the movements of automatic mechanism 78 must be coordinated very closely, so that it is possible to move about between cables 34 and 36 which act to raise and lower cages 40. These movements are shown diagrammatically in FIGS. 2-10 for each of pallets 44 and 46 and for different positions of the bricks on the pallets.

Figure 2:
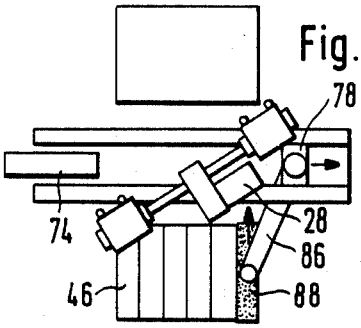

In FIGS. 2-10, winch 28 has only been shown in FIG. 2 in order to indicate its exact location and avoid overburdening the other FIGURES. Because the positions of cables 34 and 36 change according to the state of winding on drums 30 and 32, in each of the two drawings they have been represented by two points illustrating their end positions. In the following description, a "withdrawal" of automatic mechanism 78 is defined by a movement away from table 74, while an "advance" signifies a movement of automatic mechanism 78 towards table 74. It will be appreciated that each of the FIGURES shows diagrammatically a plan view which only illustrates the parts essential for understanding the movement of automatic mechanism 78. In FIG. 2, automatic mechanism 78 is in a position for grasping a brick located at one of the ends of pallet 46. After grasping a brick, automatic mechanism 74 must withdraw (see FIG. 3), and at the same time its tongs 88 pivot in the trigonometric direction, while its arm 86 pivots in the clockwise direction, until it is completely in line with the longitudinal axis of table 74, (this being illustrated in FIG. 10). Once this alignment has taken place, automatic mechanism 78 can advance in order to deposit the brick or bricks on intermediate storage table 74.

Figure 3:
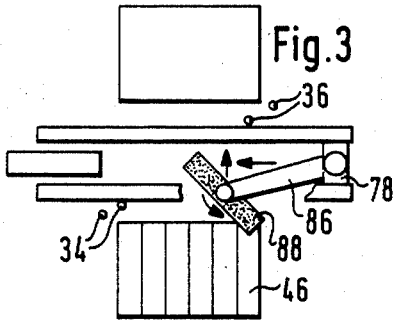
Figure 4:
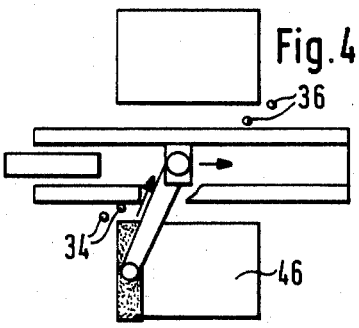
Figure 5:
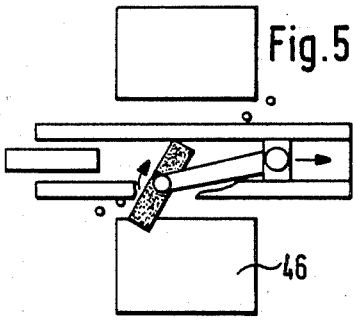

FIGS. 4 and 5 illustrate the depalletization of a brick or a pair of bricks located on the same pallet 46, but at the opposite end to the brick depalletized in FIGS. 2 and 3. After grasping the brick, automatic mechanism 78 first executes a withdrawing movement, so that the brick does not strike the cable 34 during its rotation. From a certain position of automatic mechanism 78, arm 86 and tongs 88 are rotated in the clockwise direction (see FIG. 5) into a position of alignment with table 74, and from this position automatic mechanism 78 is advanced in the direction of table 74 in order to deposit the brick thereon (see FIG. 10). It should be noted that, as illustrated in FIGS. 3 and 5, tongs 88 must rotate alternately in opposite directions, since the bricks, because of their conicity, are oriented alternately in one direction and the other on the pallets.

Figure 6:
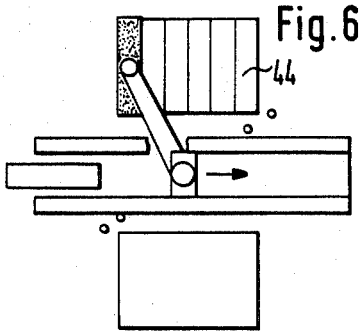
Figure 7:
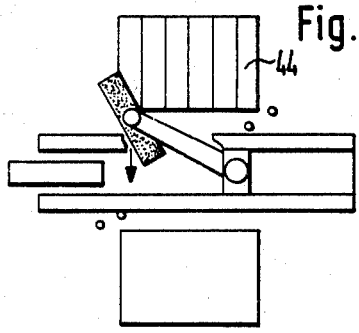

FIGS. 6-9 illustrate the depalletization of bricks located at one of the ends of pallet 44 in FIGS. 6 and 7 and at the opposite end of the pallet 44 in FIGS. 8 and 9. It will be noted that, as a result of the position of cables 34 and 36, the movements of automatic mechanism 78 require fewer precautions for depalletizing pallet 44 than for depalletizing pallet 46.

Finally, it will be appreciated by one of ordinary skill in the art that all of the movements executed by automatic depalletizing mechanism 78, as illustrated in FIGS. 2-10, are programmed as a function of the positions and orientations of the bricks on each of the pallets and are executed completely automatically in accordance with computer programs.

Whenever a layer of bricks is removed from one of pallets 44, 46, the latter is automatically lifted by its stage 56, 58 to a height corresponding to that of the depalletized layer of bricks. Instead of lifting the pallets after each depalletized layer, it is also possible to provide a deeper support 80 for the automatic mechanism 78, to make it possible to lower the arm 86 whenever a layer has been removed.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Automated apparatus for lining the inside wall of a vessel having a verticle axis with bricks comprising:

a work platform vertically movable within the vessel and capable of rotating about the vertical axis of the vessel;

means for raising and lowering brick pallets and depositing them at a predetermined location on said platform;

automatic depalletizing means;

an intermediate storage table, said automatic deplalletizing means adapted to transfer bricks from the pallets towards said intermediate storage table;

handling robot means for picking up the bricks from said intermediate storage table and lining the inside wall of the vessel;

frame means mounted on said work platform; and wherein said handling robot means comprises;

a main arm having first and second ends, said first end being supported by said frame means, said arm being radially movable with respect to said platform;

an automatic brick-handling grabbing means attached to said second end of said main arm; and said main arm and said automatic brick-handling grabbing device undergoing circular movements with respect to the vertical axis of the vessel as a result of rotation of said work platform about said vessel vertical axis.

2. The apparatus according to claim 1 including:

an electric stepping motor for generating said rotation of said work platform.

3. The apparatus according to claim 1 wherein:

said storage table is mounted underneath said main arm and is movable along a vertical axis.

4. The apparatus according to claim 3 including:

means for rotating said storage table about said vertical axis.

5. The apparatus according to claim 1 wherein said frame has two spaced rails and wherein said automatic depalletizing means comprises:

pivoting arm means having opposed ends with a first end being equipped with brick-grasping means and a second end being mounted pivotally on a support sliding parallel to said main arm between said two rails of said frame.

6. The apparatus according to claim 2 wherein said frame has two spaced rails and wherein said automatic depalletizing means comprises:

pivoting arm means having opposed ends with a first end being equipped with brick-grasping means and a second end being mounted pivotally on a support sliding parallel to said main arm between said two rails of said frame.

7. The apparatus according to claim 3 wherein said frame has two spaced rails and wherein said automatic depalletizing means comprises:

pivoting arm means having opposed ends with a first end being equipped with brick-grasping means and a second end being mounted pivotally on a support sliding parallel to said main arm between said two rails of said frame.

8. The apparatus according to claim 4 wherein said frame has two spaced rails and wherein said automatic depalletizing means comprises:

pivoting arm means having opposed ends with a first end being equipped with brick-grasping means and a second end being mounted pivotally on a support sliding parallel to said main arm between said two rails of said frame.

9. The apparatus according to claim 1 including:

a central orifice in said work platform; and rail means arranged on opposed sides of said orifice;

carriage means movably supported by said rail means; and wherein brick pallets are movable on said work platform by means of said carriage means moving on said rail means.

10. The apparatus according to claim 5 including:

movable stages on said work platform; and wherein pallets in their depalletizing position are movable vertically under the action of said movable stages.

11. The apparatus according to claim 6 including:

movable stages on said work platform; and wherein pallets in their depalletizing position are movable vertically under the action of said movable stages.

12. The apparatus according to claim 7 including:

movable stages on said work platform; and wherein pallets in their depalletizing position are movable vertically under the action of said movable stages.

13. The apparatus according to claim 8 including:

movable stages on said work platform; and wherein pallets in their depalletizing position are movable vertically under the action of said movable stages.

14. The apparatus according to claim 9 including:

movable stages on said work platform; and wherein pallets in their depalletizing position are movable vertically under the action of said movable stages.

15. The apparatus of claim 1 including:

said automatic depalletizing means is positioned within said frame means.

16. The apparatus of claim 1 including:

monitoring station means on said work platform.

* * * * *